US012687369B2

(12) United States Patent
Bowmar et al.

(10) Patent No.: US 12,687,369 B2
(45) Date of Patent: Jul. 21, 2026

(54) ARCHERY RELEASE

(71) Applicant: Bowmar Archery LLC, Des Moines, IA (US)

(72) Inventors: Joshua Bowmar, Ankeny, IA (US); David Houser, Creekside, PA (US)

(73) Assignee: Bowmar Archery LLC, Des Moines, IA (US)

( * ) Notice: Subject to any disclaimer, the term of this patent is extended or adjusted under 35 U.S.C. 154(b) by 94 days.

(21) Appl. No.: 18/583,349

(22) Filed: Feb. 21, 2024

(65) Prior Publication Data

US 2024/0280343 A1 Aug. 22, 2024

Related U.S. Application Data

(60) Provisional application No. 63/486,382, filed on Feb. 22, 2023.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS 3,965,884 A * 6/1976 Killian ..... F41B 5/1469 124/35.2
6,953,035 B1 * 10/2005 Summers ..... F41B 5/1469 124/35.2
9,027,540 B2 * 5/2015 Springer ..... F41B 5/1469 124/90
9,261,323 B2 * 2/2016 Springer ..... F41B 5/1469
9,702,658 B2 * 7/2017 Horn ..... F41B 5/1469
9,970,731 B2 * 5/2018 Horn ..... F41B 5/1469
10,281,231 B2 * 5/2019 Springer ..... F41B 5/1469
10,641,578 B2 5/2020 Springer
10,731,943 B2 * 8/2020 Horn ..... F41B 5/1469
10,746,501 B2 8/2020 Springer
10,830,554 B1 * 11/2020 Jones ..... F41B 5/1469
11,262,154 B2 3/2022 Springer
11,994,359 B2 5/2024 Springer
12,140,398 B2 11/2024 Springer
2011/0168146 A1 * 7/2011 Deceuster ..... F41B 5/1469 124/80
2017/0089663 A1 * 3/2017 Horn ..... F41B 5/1469
2024/0318936 A1 9/2024 Springer et al.

* cited by examiner

*Primary Examiner* — John A Ricci
(74) *Attorney, Agent, or Firm* — Banner & Witcoff, Ltd.

(57) ABSTRACT

An archery release includes a hook that receives a force from a hook resilient member to help push the hook away from a moon when the archery release is moved to a released position. The archery release may comprise a body that includes a plurality of finger engagement surfaces, and a release extension that extends outward from between a first finger engagement surface and a second engagement surface. The archery release may also include a head pivotally connected to the release extension, a moon pivotally attached to the release extension, where the moon comprises a generally curved upper surface, a hook pivotally connected to the head, where the hook comprises a hook-shaped portion and a lower engaging surface, and a hook resilient member that applies a force to the hook.

20 Claims, 12 Drawing Sheets

ARCHERY RELEASE

CROSS-REFERENCE TO RELATED APPLICATIONS

This application claims priority to and the benefit of U.S. Provisional Patent Application No. 63/486,382 filed on Feb. 22, 2023, which is incorporated by reference in its entirety.

TECHNICAL FIELD

The present disclosure relates to an archery bowstring release.

BACKGROUND

Archery releases are used to hold a bowstring of an archery bow so that a user can pull on the archery release which then draws the bowstring to shoot an arrow from the bow. An archery release can assist a user to consistently and cleanly release the bowstring to increase the accuracy of the user in shooting the intended target.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

This disclosure may relate to an archery release comprising: (a) a body comprising a plurality of finger engagement surfaces, where each finger engagement surface includes a concave surface, (b) a moon pivotally connected to the body, where the moon comprises a generally curved upper surface; (c) a hook pivotally connected to the body, where the hook comprises a hook-shaped portion and a lower engaging surface; and (d) a hook resilient member that applies a force to the hook. When the archery release is in a holding position, the lower engaging surface of the hook may contact the curved upper surface of the moon, and when the archery release is in a released position, the lower engaging surface of the hook may be free of contact with the moon, where the force of the hook resilient member may exert a rotational force onto the hook to help rotate the hook and to move the hook away from the moon as the archery release moves from the holding position to the released position. The lower engaging surface of the hook may be slidingly engaged with the curved upper surface of the moon when the archery release is in the holding position. The curved upper surface of the moon may comprise a first curved upper surface and a second curved upper surface positioned below and adjacent to the first curved upper surface with a step between the first curved upper surface and the second curved upper surface. When the lower engaging surface of the hook moves from the first curved upper surface to the second curved upper surface, the archery release may produce an audible sound to alert that the archery release is in an imminent release position. The first curved upper surface and the second curved upper surface may both have a generally curved convex shape. The step may be an adjustable step such that a distance between a leading edge of the first curved upper surface and a leading edge of the second curved upper surface is adjustable. The moon may comprise an adjustable mechanical element on a first side of a moon pivot member and a step resilient member located on a second side of the moon pivot member opposite the first side such that the adjustable mechanical element is adjustable to modify the distance between the leading edge of the first curved upper surface and the leading edge of the second curved upper surface. The moon may further comprise a magnetic element below the adjustable mechanical element that applies a magnetic force onto the adjustable mechanical element. The hook resilient member may be a dual torsion spring that applies the force to a rear surface of the hook. The archery release may further comprise a head that is pivotally connected to the body, where the hook is pivotally connected to the head, and a moon resilient member that exerts a force on the moon, where the hook resilient member and the moon resilient member are both arranged on a rod connected to the head. In addition, the archery release may further comprise an adjustable finger member that is configured to move in top-to-bottom direction and in a forward-to-rearward direction. In some examples, the body of the archery release may include a release extension that extends outward from between a first finger engagement surface and a second engagement surface of the plurality of finger engagement surfaces, and a lower surface of the moon may be configured to contact a moon stop positioned on the release extension, where a height of the moon stop is adjustable.

Other aspects of this disclosure may relate to an archery release comprising: (a) a body comprising a plurality of finger engagement surfaces, where each finger engagement surface includes a concave surface, and a release extension that extends outward from between a first finger engagement surface and a second engagement surface of the plurality of finger engagement surfaces; (b) a head pivotally connected to the release extension, where the head comprises a central opening; (c) a moon pivotally connected to the release extension, where the moon comprises a first generally curved upper surface, and a second generally curved upper surface, where the first curved upper surface is offset from and adjacent to the second curved upper surface; (d) a hook pivotally connected to the head and positioned within the central opening of the head, where the hook comprises a hook shaped portion, a rear surface, and a lower engaging surface; (e) a hook resilient member that applies a first force to the hook; and (f) a moon resilient member that exerts a second force on the moon, and where the hook resilient member and the moon resilient member are both arranged on a rod connected to the head. When the archery release is in a holding position, the lower engaging surface of the hook may contact the first curved upper surface of the moon, and when the archery release is in an imminent release position, the lower engaging surface of the hook may contact the second curved upper surface of the moon. And when the archery release is in a released position, the lower engaging surface of the hook may be free of contact with the moon, where the first force of the hook resilient member helps to rotate the hook. The lower engaging surface of the hook moves from the first curved upper surface to the second curved upper surface, the archery release may produce an audible sound to alert that the archery release is in the imminent release position. The lower engaging surface of the hook may be slidingly engaged with the first curved upper surface of the moon when the archery release is in the holding position. The archery release may further comprise an adjustable finger member that is configured to move in top-to-bottom direction and in a forward-to-rearward direction. The body may also include a slot arranged on a side surface of the body, where movement of a control member in the slot moves the adjustable finger member relative to the body. The moon may further comprise a third curved upper surface spaced from the first curved upper surface and adjacent to the second curved upper surface, such that when the archery release is in the holding position, the lower engaging surface of the hook may contact both the first curved upper surface and the third curved upper surface.

Yet additional aspects of this disclosure may relate to an archery release comprising: (a) a body comprising a plurality of finger engagement surfaces, where each finger engagement surface includes a concave surface, and a release extension that extends outward from between a first finger engagement surface and a second engagement surface of the plurality of finger engagement surfaces; (b) a head pivotally connected to the release extension, where the head comprises a central opening; (c) a moon pivotally connected to the release extension, where the moon comprises a generally curved first curved upper surface, and a generally curved second curved upper surface, where a leading edge of the first curved upper surface is offset a distance from a leading edge of the second curved upper surface, and where the moon comprises a mechanical element on a first side of a moon pivot member, such that adjustment of the mechanical element modifies the distance of the leading edge of the first curved upper surface to the leading edge of the second curved upper surface; (d) a hook pivotally connected to the head and positioned within the central opening of the head, where the hook comprises a hook shaped portion, a rear surface, and a lower engaging surface; and (e) a hook resilient member that applies a force to the hook. When the archery release is in a holding position, the lower engaging surface of the hook may contact the first curved upper surface of the moon, and when the archery release is in an imminent release position, the lower engaging surface of the hook may contact the second curved upper surface of the moon. And when the archery release is in a released position, the lower engaging surface of the hook may be free of contact with the moon, where the force of the hook resilient member helps to rotate the hook and to push the hook away from the moon. The hook resilient member may be a dual torsion spring that applies the force to the rear surface of the hook.

BRIEF DESCRIPTION OF DRAWINGS

The present disclosure is illustrated by way of example and not limited in the accompanying figures in which like reference numerals indicate similar elements and in which.

DETAILED DESCRIPTION OF THE INVENTION

Figure 1:
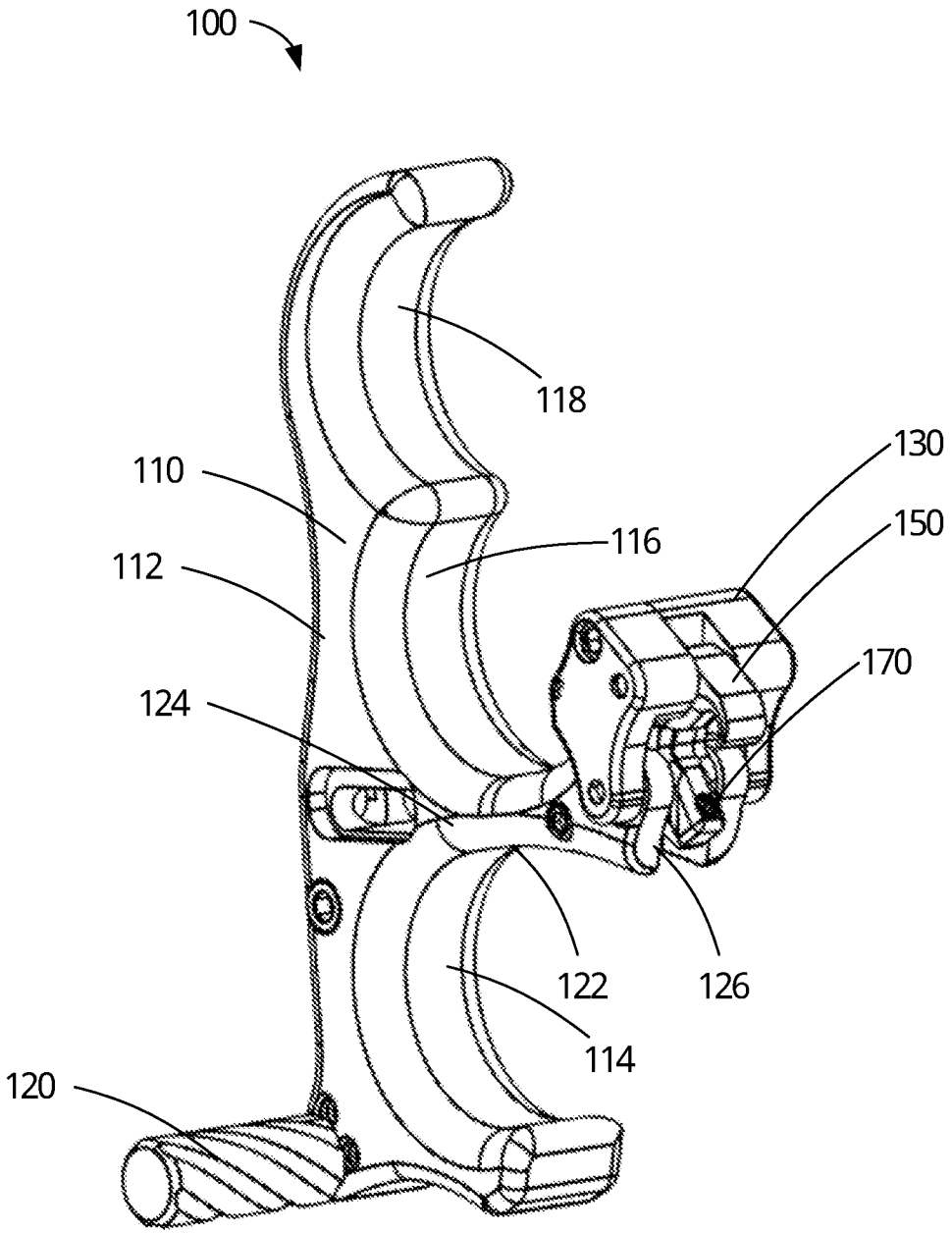
FIG. 1 depicts a perspective view of an exemplary archery release according to aspects described herein.

In the following description of the various examples, reference is made to the accompanying drawings, which form a part hereof, and in which is shown by way of illustration various examples in which aspects of the disclosure may be practiced. It is to be understood that other examples may be utilized and structural and functional modifications may be made without departing from the scope and spirit of the present disclosure. Also, while the terms "top," "bottom," "front," "side," and the like may be used in this specification to describe various example features and elements of the examples, these terms are used herein as a matter of convenience, e.g., based on the example orientations shown in the figures or the orientation during typical use. Nothing in this specification should be construed as requiring a specific three-dimensional orientation of structures in order to fall within the scope of this disclosure.

The following terms are used in this specification, and unless otherwise noted or clear from the context, these terms have the meanings provided below.

"Generally perpendicular" means that a surface or edge forms an angle of 90 degrees+/−10 degrees with another surface or edge.

"Connected" or "attached" means that a surface, component, feature, or element may be directly or indirectly linked, attached, or coupled.

Aspects of this disclosure may relate to an archery release that engages a loop member, such as a d-loop, that is attached to a bowstring or directly engages a bowstring of an archery bow. The archery release may have a hook that engages the loop member (or bowstring) such that a user may use the release to pull or draw the bowstring to put the bow in a position ready to shoot an arrow at a designated target. The archery release may then be manipulated by a hand of a user from a holding or ready position used to draw the bowstring into a position where the arrow is ready to shoot. Optionally, the release may have an imminent release position, where only the slightest movement from the user's hand causes the hook to release the loop member. In addition, the release may have a released position, where the hook moves away from the loop member and releases the loop member to fire the arrow.

FIGS. 1-16 illustrates an exemplary archery release 100. As shown in FIGS. 1 and 3-5, the archery release 100 may comprise a body 110 that includes a base 112 with a plurality of finger engagement surfaces 114, 116, 118, a thumb member 120, and a release extension 122 that extends outward or forward from the base 112 of the body 110 from a fixed end 124 to a free end 126. The release 100 may also include a head 130 pivotally connected or attached to the release extension 122 of the body 110. A hook 150 may be pivotally connected to the head 130 along a pivot member 158. In some embodiments, the hook 150 may be connected to the body 110. A moon or sear 170 may be pivotally connected to the release extension 122 of the body 110 along a moon pivot member 180. In some examples, the fixed end 124 of the release extension 122 may be located the between the first finger engagement surface 114 and a second finger engagement surface 116. Each finger engagement surface 114, 116, 118 may include a concave surface, while the release extension 122 may extend in a generally perpendicular direction to the base 112. The thumb member 120 may have a generally cylindrical shape and in some cases have a knurled or textured surface finish. The finger engagement surfaces 114, 116, 118 and the thumb member 120 allow the user the engage and control the movement of the archery release 100. While the exemplary release 100 illustrated in FIGS. 1-16 has three finger engagement surfaces 114, 116, 118, the release may include two finger engagement surfaces or four finger engagement surfaces.

Figure 2:
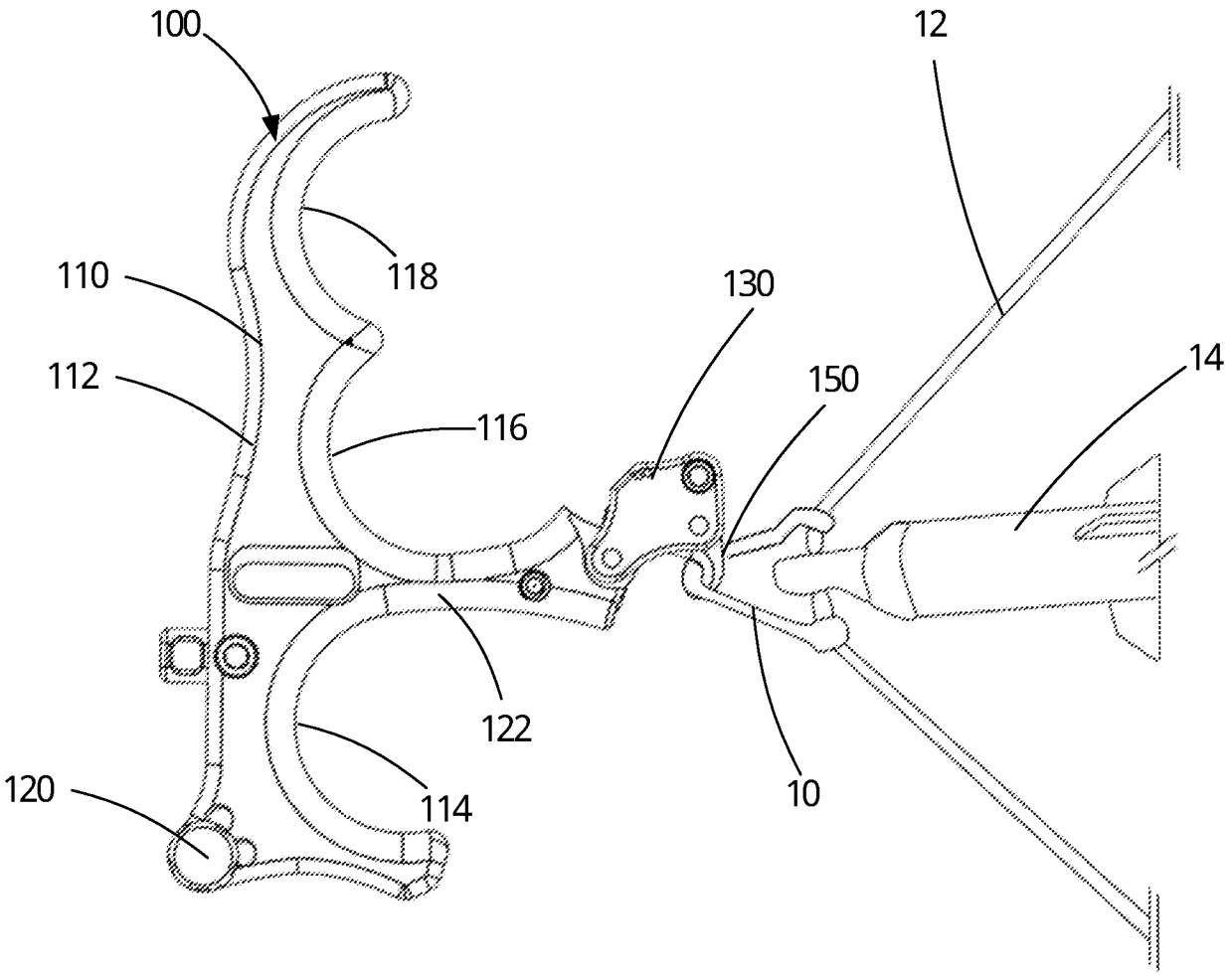
FIG. 2 depicts a perspective view of an exemplary archery release engaged with a loop member on a bowstring of an archery bow according to aspects described herein.
Figure 3:
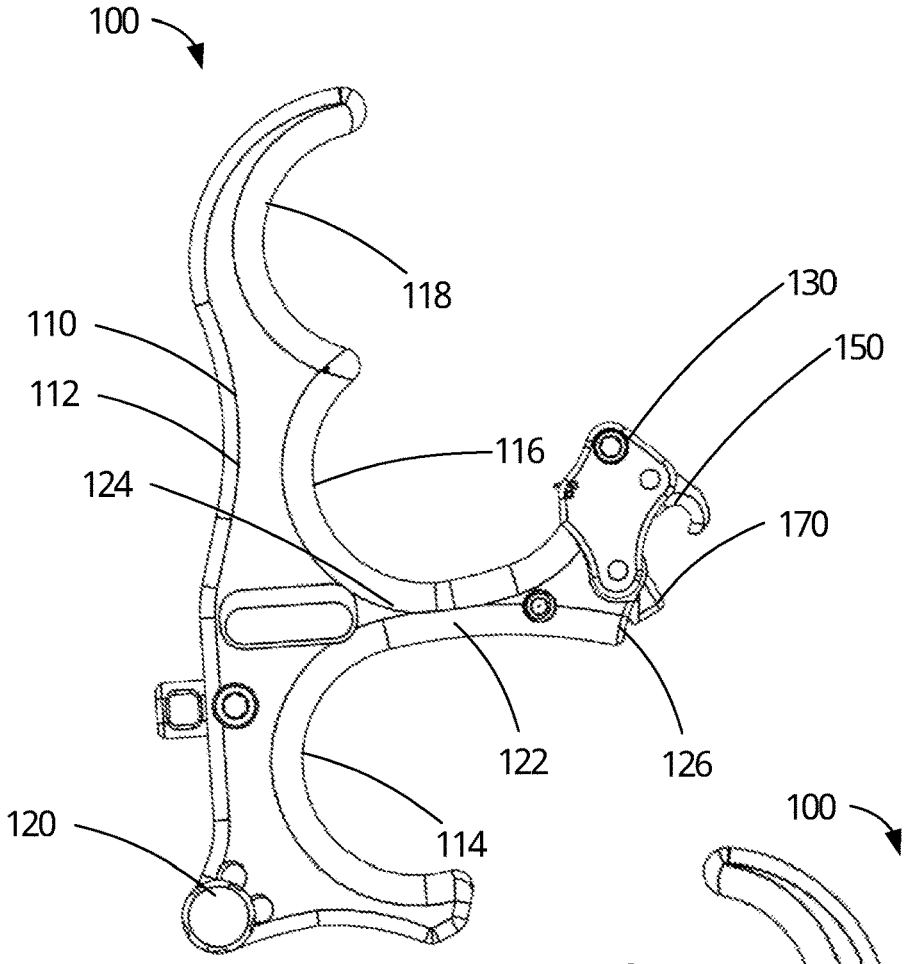
FIG. 3 depicts a front view of the exemplary archery release of FIG. 1 according to aspects described herein.
Figure 4:
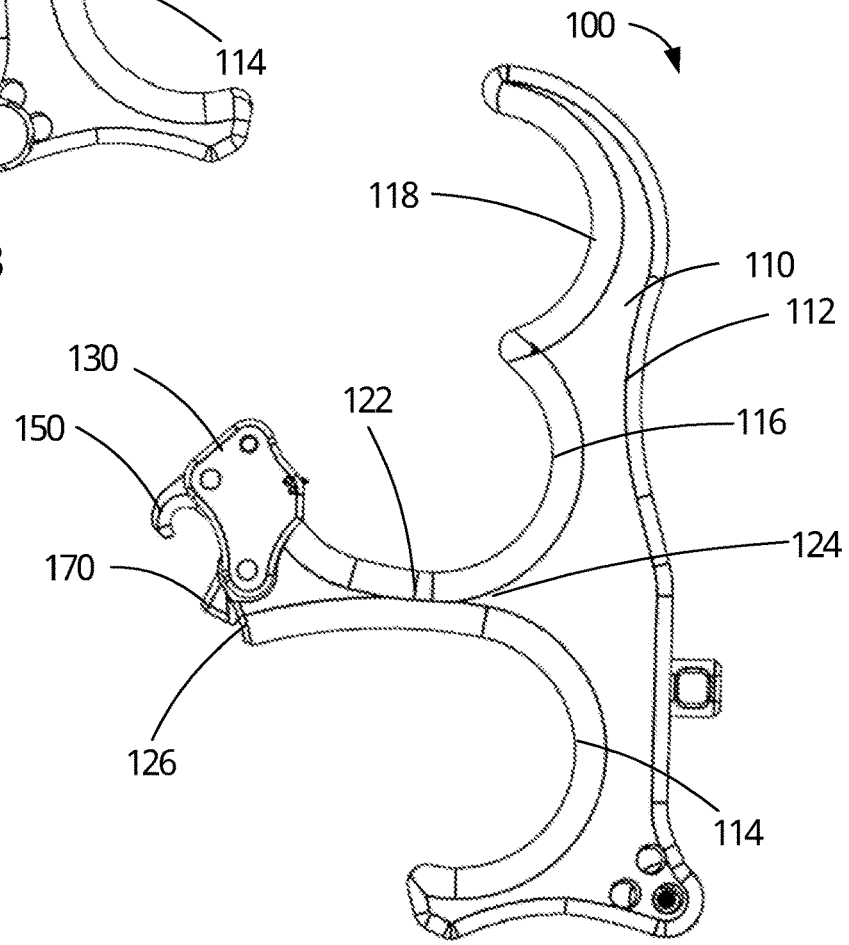
FIG. 4 depicts a rear view of the exemplary archery release of FIG. 1 according to aspects described herein.
Figure 5:
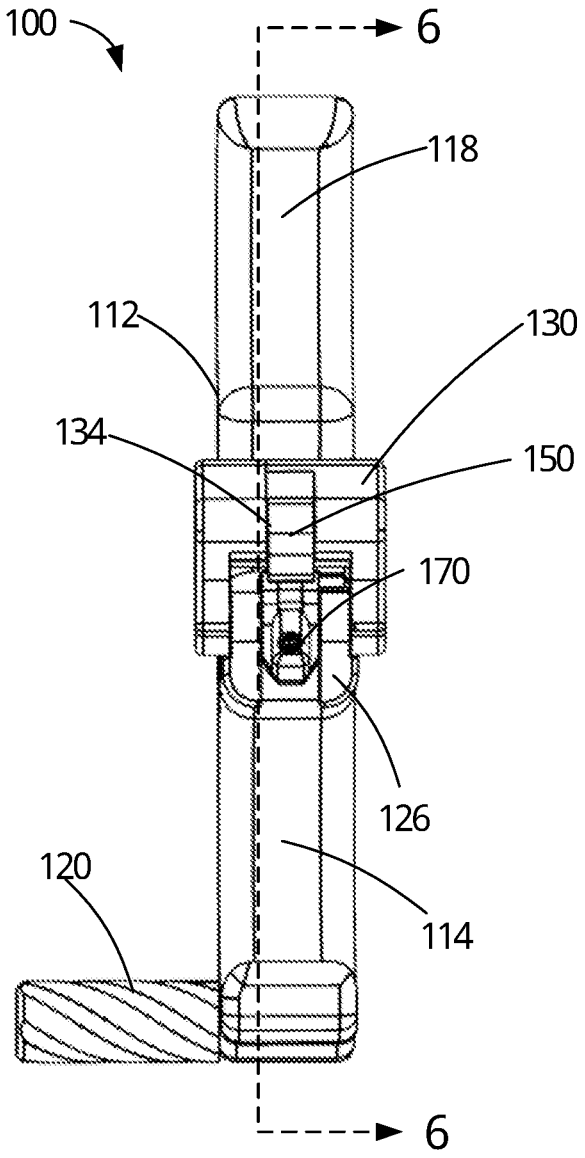
FIG. 5 depicts a side view of the exemplary archery release of FIG. 1 according to aspects described herein.

FIG. 2 illustrates an archery release 100 with a hook 150 engaging a loop member 10 that is attached to a bowstring 12 and an arrow 14 attached to the bowstring 12. A user is not shown in FIG. 2 for clarity. The archery release 100 in FIG. 2 is shown in a holding position or ready position. A user (not shown) may grasp the release 100 with a hook 150 that engages the loop member 10 and pull the release 100 rearward to draw the bowstring 12. As shown, each finger engagement surface may engage one of the user's fingers. For instance, the first finger engagement surface 114 may engage a user's index finger, and the second finger engagement surface 116 may engage a user's middle finger. Additionally, the third finger engagement surface 118 may engage a user's ring finger, and in configurations with a fourth finger engagement surface (not shown), the fourth finger engagement surface may engage a user's little finger. As a user increases the tension in the bowstring 12, the hook 150 of the archery release may slide or move relative to the moon 170. To release the loop member 10 (and the bowstring 12) a user increases the tension in a middle and/or ring finger of the user's hand causing the hook 150 to rotate around its pivot point and move to a released position. As the hook 150 rotates and moves to the released position, the hook 150 releases the loop member 10 causing the arrow to head to move toward the target. Optionally, to release the loop member 10, in addition to increasing the tension in a middle and/or ring finger, a user may relax or extend an index finger to cause the hook 150 to rotate around its pivot point and move to a released position. While the release 100 is in a holding position, the interaction between the moon 170 and the hook 180 prevents the hook 180 from rotating, and upon receiving input from a user causing or allowing relative rotation of the moon 170 and the hook 180, the release 100 is moved to a released position.

Figure 6:
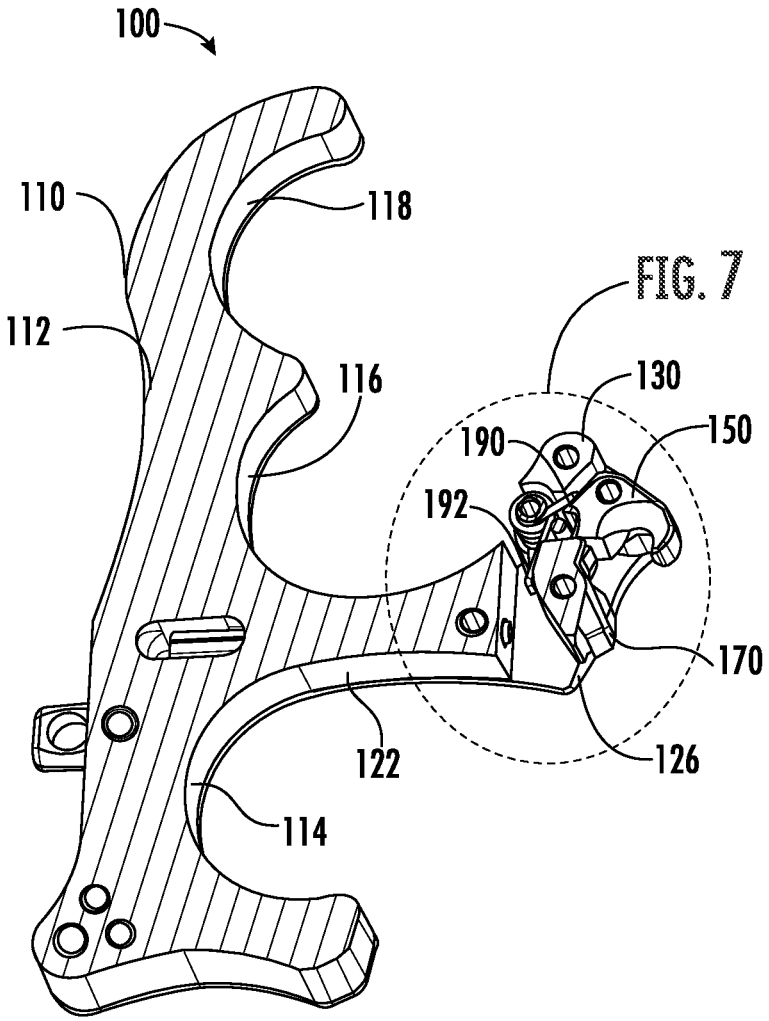
FIG. 6 depicts a partial perspective cross-sectional view of the exemplary archery release of FIG. 1 along line 6-6 according to aspects described herein.
Figure 7:
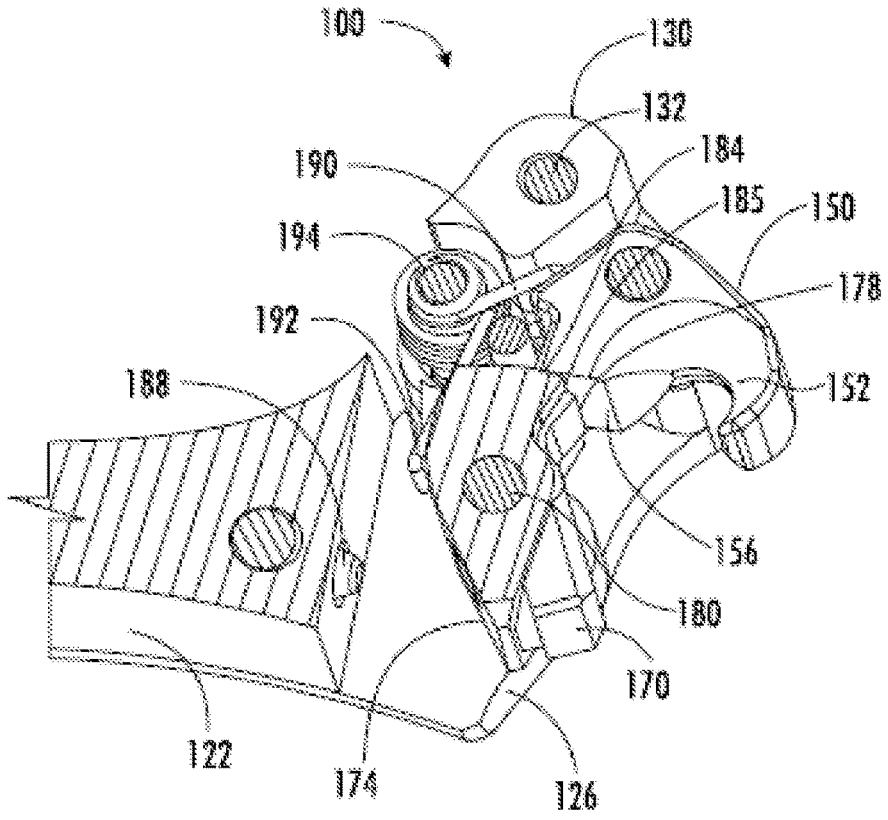
FIG. 7 depicts an enlarged cross-sectional view of the exemplary archery release of FIG. 6 according to aspects described herein.
Figure 8:
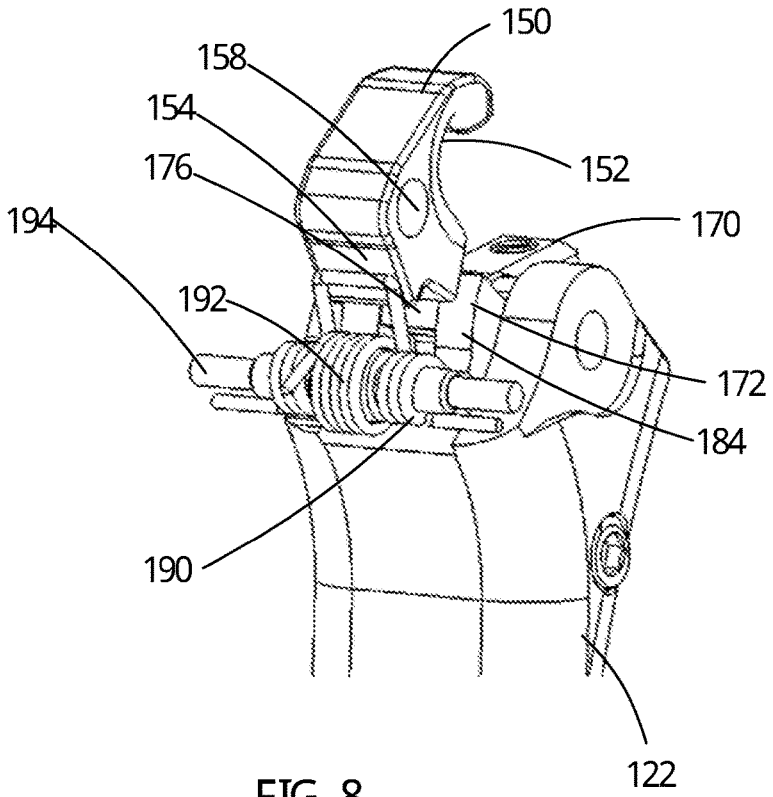
FIG. 8 depicts a partial perspective view of the exemplary archery release of FIG. 1 with some components removed for clarity according to aspects described herein.

FIGS. 6 and 7 illustrate cross-sectional views of the exemplary release 100 while FIG. 8 illustrates a perspective view of the exemplary release 100 with the head 130 removed to show the interaction between the hook 150 and the moon 170 and the arrangement of a pair of resilient members 190, 192 while the release 100 is in a holding position. The head 130 may be pivotally connected to the release member along a pivot axis 132 and may include a central opening 134. The hook 150 and the moon 170 may be generally located within at least a portion of the central opening 134. The hook 150 may include a hook-shaped portion 152, a rear surface 154, and a lower or engaging surface 156 that contacts the moon 170 when the release 100 is in the holding position and the imminent firing position. The moon 170 may include an upper surface 172 that has a curved and/or convex shape that is in contact engaging surface 156 when the release is in the holding position and the imminent firing position. In some examples, the upper surface 172 may have a shape that has a constant radius, or the shape may be a combination of radii, or may be a smoothly curved surface without distinct radii with a generally convex shape. While the engaging surface 156 and upper surface 172 are in contact, the moon 170 and hook 150 may be slidingly engaged with one another along the two surfaces 172, 156. A hook resilient member 190 may be arranged to apply a force to the rear surface 154 of the hook 150 to help push the hook 150 away from moon 170 and to release the loop member 10 (or the bowstring 12) when the release 100 moves into a released position.

The hook resilient member 190 may contact the rear surface 154 at a location below the pivot member 158 such that the force produced by the hook resilient member 190 exerts both a rotational force around the pivot member 158 and a translational force. The force exerted on the hook 150 by the hook resilient member 190 helps to move the hook 150 both translationally and rotationally to allow the hook 150 to release the loop member 10 with minimal interaction that could affect the accuracy. As the hook 150 becomes free of contact with the moon 170, the hook 150 may still be engaged with the loop member 10 briefly. Because the hook resilient member 190 provides a force to the rear surface 154 below the pivot member 158, the force will cause the hook 150 to rotate as soon as it loses contact with the moon 170.

As the hook 150 rotates, the loop member 10 is released from the hook-shaped portion 152. This rotation assisted by the force provided by the hook resilient member 190 may reduce the time required for the hook 150 to release the loop member 10 when compared to typical archery release. By reducing the time for the hook 150 to release the loop member 10, any possible interaction between the hook 150 and the loop member 10 that can negatively affect the accuracy of the arrow's path to the target may be reduced. This improved accuracy can be advantageous for a user to consistently hit his/her intended target.

The hook resilient member 190 may be a torsion spring that is arranged along rod 194 connected to the head 130. In the illustrated example, the torsion spring may be a dual torsion spring or other torsional spring known to one skilled in the art. In other examples, the hook resilient member 190 may be a compression spring, flat spring, tension spring, or other type of resilient member known to one skilled in the art.

In addition, the release 100 may include a moon resilient member 192 that exerts a force on the moon 170 to help keep the orientation of the moon 170 in a same relationship with the head 130 until a lower surface 174 of the moon 170 contacts a moon stop 188 on the release extension 122, which will be described in more detail later. The moon resilient member 192 may be a torsional spring arranged on the rod 194. In some illustrated example, the moon resilient member 192 is arranged between the ends of the hook resilient member 190 when the hook resilient member 190 is a dual torsion spring. In other examples, the moon resilient member 192 may be a compression spring, flat spring, tension spring, or other type of resilient member known to one skilled in the art.

The release 100 may produce an audible sound to alert the user that the release 100 has moved to an imminent release position where any additional tension caused by the user will cause the hook 150 to move away from the moon 170 causing the release of the loop member 10 from the hook 150. To produce an audible sound, the upper surface 172 of the moon 170 may be separated into a pair of curved upper surfaces 175, 176. The first curved upper surface 175 may be positioned offset and adjacent to the second upper surface 176, which creates a step between the two curved upper surfaces 175, 176. In some examples, the first curved upper surface 175 may be positioned slightly above the second upper surface 176. Additionally, the leading edge 177 of first curved upper surface 175 may be slightly rearward of the leading edge 178 of the second upper surface 176. As the engaging surface 156 of the hook 150 slides along the first curved upper surface 175, the engaging surface 156 may be free of contact with the second upper surface 176. When the release 100 moves to the imminent release position, the engaging surface 156 may slide off the leading edge 177 of the first curved upper surface 175 and then contact the second upper surface 176. As the hook 150 slides off the first curved upper surface 175 and contacts the second upper surface 176, the contact between the hook 150 and the second upper surface 176 may produce an audible sound to alert the user that the release of the loop member 10 by the hook 150 is imminent (i.e. the release 100 is in the imminent release position). In some examples, like the illustrated example in FIGS. 1-16, the upper surface 172 may comprise three curved upper surfaces 175, 176, 184. The third curved upper surface 184 may be adjacent to the second curved upper surface 176 and spaced from the first curved upper surface 175, such that the second upper surface 176 is positioned between the first curved upper surface 175 and the third upper surface 184. The third upper surface 184 may have an identical surface profile as the first curved upper surface 175 (i.e. within 2% of each other). Thus, the lower surface 156 of the hook 150 may contact and slidingly engage the third upper surface 184 when the release 100 is in the holding position. In some examples, the lower surface 156 of the hook 150 may contact and slidably engage both the first curved upper surface 175 and the third curved upper surface 184 when the release 100 is in the holding position. The leading edge 177 of the first curved upper surface 175 may be collinear with a leading edge 185 of the third upper surface 184. The distance between the first upper surface leading edge 177 and the second upper surface leading edge 178 may be less than 1 mm, or within a range of 0.2 mm and 1.0 mm, or within a range between 0 mm and 2 mm. While the distance between the pair of curved upper surfaces 175, 176 may be less than 0.5 mm or within a range of 0.05 mm and 0.75 mm. In some examples, the first curved upper surface 175 and the second upper surface 176 may be coaxial, where the first upper surface 175 has a radial profile that is larger than a radial profile of the second upper surface 176. For instance, the radius of the first curved upper surface 175 may be approximately 0.25 mm larger than the radius of the second curved upper surface 176, or the radius of first curved upper surface 175 may be larger than the radius of the second upper surface by an amount within a range of 0.05 mm and 0.75 mm.

Figure 9:
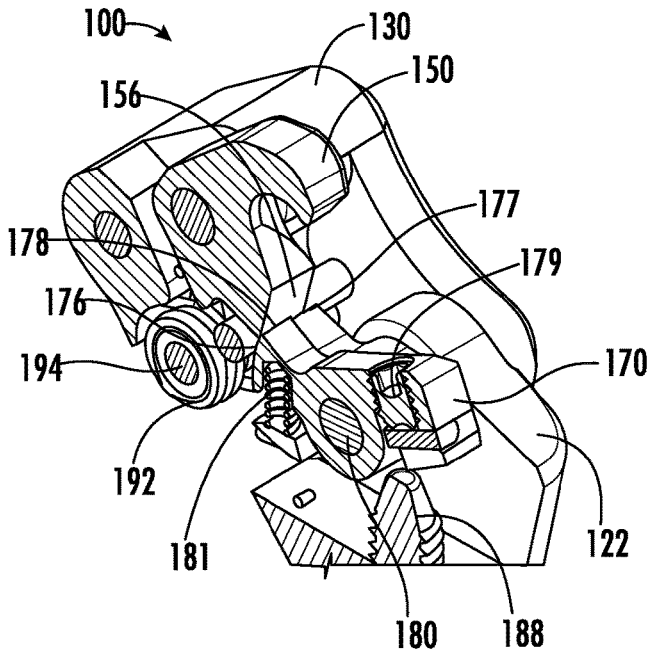
FIG. 9 depicts a partial perspective cross-sectional view of the exemplary archery release of FIG. 1 along line 6-6 according to aspects described herein.
Figure 10:
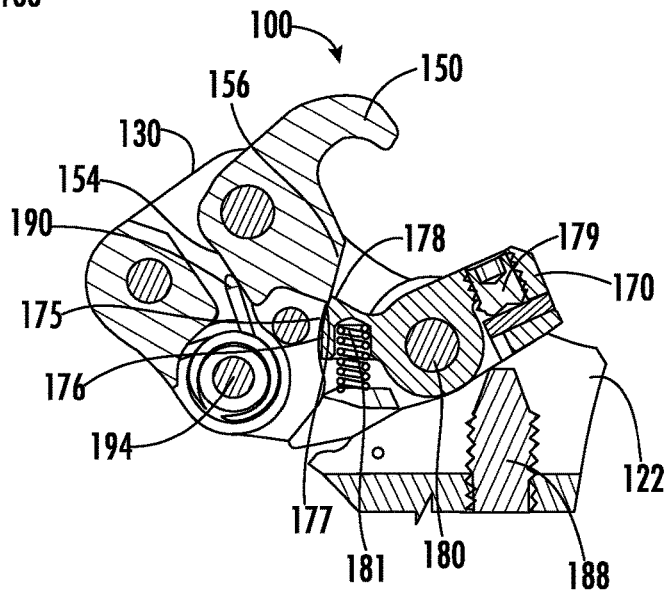
FIG. 10 depicts a partial side cross-sectional view of the exemplary archery release of FIG. 9 according to aspects described herein.
Figure 11:
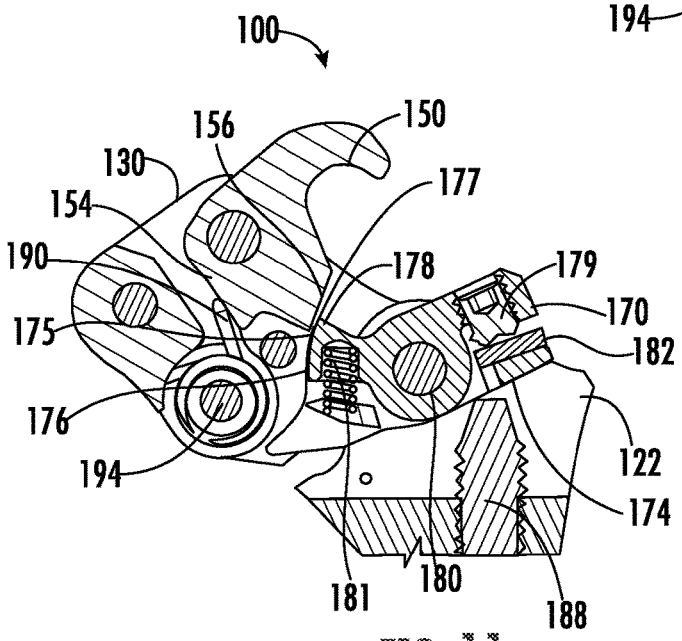
FIG. 11 depicts a partial side cross-sectional view of the exemplary archery release of FIG. 9 according to aspects described herein.
Figure 23:
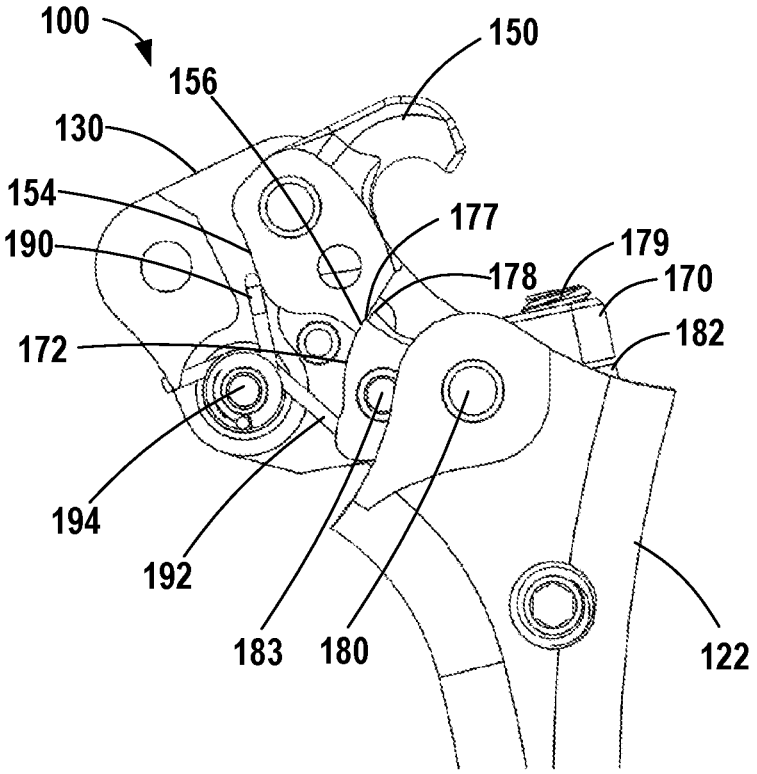
FIG. 23 depicts a partial front view of an alternate archery release of FIG. 1 with a portion of the head removed with the hook member contacting the moon according to aspects described herein.

In addition, the pair of curved upper surfaces 175, 176 of the moon 170 may be adjustable to allow a user to modify or adjust the relative positions of the first curved upper surface 175 and the second upper surface 176 to each other, which may adjust the distance between the leading edge 177 of the first curved upper surface 175 and the leading edge 178 of the second curved upper surface 176 while the height of the step between the first curved upper surface 175 and the second upper surface 176 may remain constant or unchanged. The distance between the leading edge 177 and the leading edge 178 may determine the amount of additional rotation or movement of the hook 150 along the second upper surface 176 before the hook 150 is free of contact with the moon 170 (i.e. the length of travel on curved upper surface 176 required for the hook 150 to travel to move the release 100 from the imminent release position to the released position). The moon 170 may include a mechanical element 179 on a forward side of the moon pivot member 180 and a step resilient member 181, which may be a compression spring, on a rearward side of the moon pivot member 180 as shown in FIGS. 9-11. The mechanical element 179 may be adjusted to change the relative positions of the second upper surface 176 and the first and third curved upper surfaces 175 and 184. In particular, the mechanical element 179 may be adjusted to change the distance between the leading edges 177 and 178 to change the length of travel of the curved upper surface 176 of the imminent release position. For instance, in the example moon 170 shown in FIGS. 9 and 10, the distance between the leading edge 177 of the first curved upper surface 175 and the leading edge 177 of the first curved upper surface 175 and the leading edge 178 of the second upper surface 176 is at a maximum or at least a predetermined distance. In some examples, the predetermined distance may be up to 2 mm. The step resilient member 181 opposite the mechanical element 179 helps to ensure the two curved upper surfaces 175, 176 move consistently and also to keep the two curved upper surfaces 175, 176 in their proper positions. Alternatively, if the mechanical element 179 is adjusted downward, the distance between the leading edge 177 and the leading edge 178 decreases as shown in FIG. 11. In some instances, like the example of FIG. 11, the distance between the leading edge 177 and the leading edge 178 may be zero where the leading edges 177, 178 are parallel to each other, such that the lower surface 156 of the hook 150 is clear of both surfaces at the same time such that the release 100 moves from the holding position directly to the released position bypassing the imminent release position without producing the audible sound to alert a user of the imminent release. In addition, the moon 170 may include a magnet 182 positioned below the mechanical element 179 to apply a magnetic force onto the mechanical element 179, which may also be formed from a magnetic or ferromagnetic material, to prevent any unintended movement of the mechanical element 179 from any shock or vibration forces. The mechanical element 179 may be a set screw or other fastener element as known to one skilled in the art. In some examples, a mechanical element 183 may be received in a side wall of the moon 170 to releasably fix the upper surfaces 175, 176, 184 together as shown in FIG. 23. The mechanical fastener 183 may be oriented generally perpendicular to a side surface of the moon 170. The mechanical element 183 may be a set screw or other fastener element as known to one skilled in the art. Alternatively, in some examples, the moon 170 may have a single upper surface 172 that slidably engages the lower surface 156 of the hook 150 such that when the hook 150 is clear of single upper surface 172, the release 100 moves from the holding position directly to the released position without producing the audible sound to alert a user of the imminent release.

Figure 13:
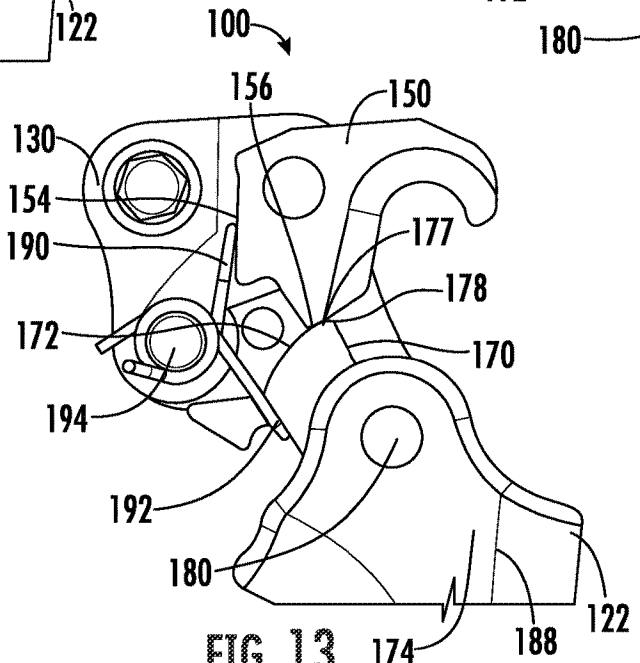
FIG. 13 depicts a partial front view of the exemplary archery release of FIG. 1 with a portion of the head removed with the hook member contacting the moon according to aspects described herein.
Figure 12:
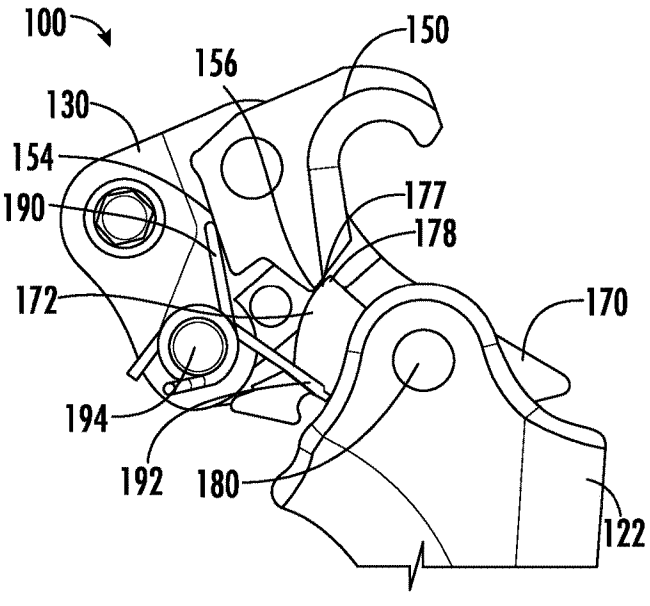
FIG. 12 depicts a partial front view of the exemplary archery release of FIG. 1 with a portion of the head removed with the hook member contacting the moon according to aspects described herein.

FIGS. 12-16 illustrates the movement of the hook 150 of the release 100 moving from a holding position to a released position. For example, FIG. 12 illustrates the release 100 with the hook 150 slidingly engaged with the moon 170. As the user increases the tension in the bowstring (not shown), the lower surface 156 of the hook 150 is slidingly engaged with the upper surface 172 of the moon 170. The hook resilient member 190 is applying a force to the rear surface 154 of the hook 150. The moon resilient member 192 is applying a force to the moon 170 to move with the head 130. As the tension increases due to the user's movement of the release 100, the moon 170 rotates until the lower surface 174 contacts the moon stop 188 as shown in FIG. 13. In some examples, the moon stop 188 may be adjustable such that a user may set the height of the moon stop 188 depending on the user's preference. In some examples, the moon stop 188 may be a set screw or other mechanical element as known to one skilled in the art.

Figure 14:
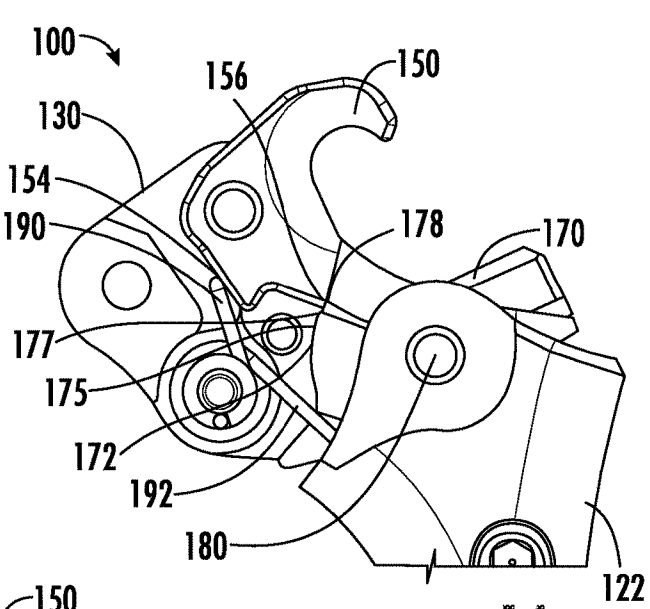
FIG. 14 depicts a partial front view of the exemplary archery release of FIG. 1 with a portion of the head removed with the hook member contacting the moon according to aspects described herein.

As the tension continues to increase, the hook 150 continues to move forward and moves to the imminent release position by sliding past the leading edge 177 of the first curved upper surface 175 and onto the second curved upper surface 176 as shown in FIG. 14. During this imminent release position, the audible sound may be produced as the lower surface 156 of the hook 150 contacts the second upper surface 176. In addition, the edge of the hook resilient member 190 begins to move lower on the rear surface 154 of the hook 150 creating more rotational force on the hook 150.

Figure 16:
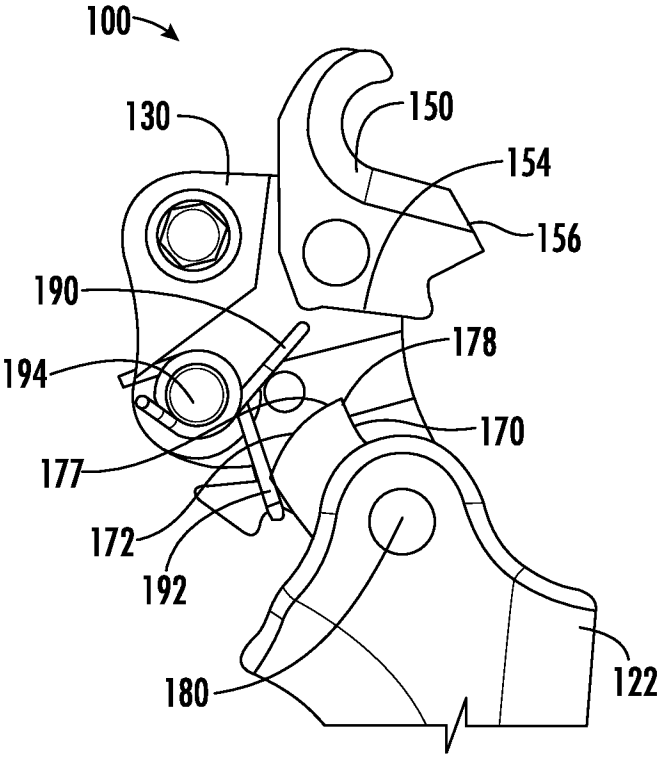
FIG. 16 depicts a partial front view of the exemplary archery release of FIG. 1 with a portion of the head removed with the hook member free of contact with the moon according to aspects described herein.
Figure 15:
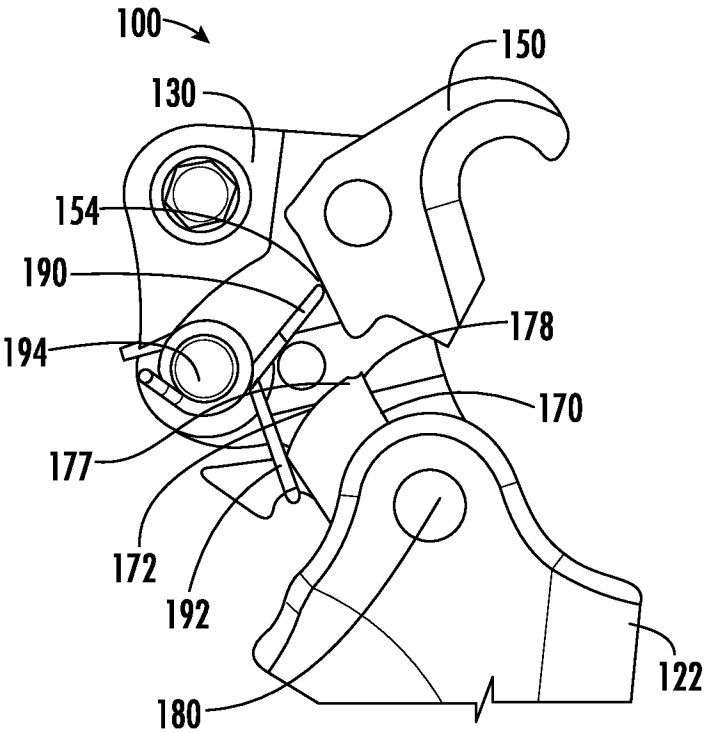
FIG. 15 depicts a partial front view of the exemplary archery release of FIG. 1 with a portion of the head removed with the hook member free of contact with the moon according to aspects described herein.

FIG. 15 illustrates the release 100 in the released position where the hook 150 has moved forward free of contact the moon 170 causing the loop member and bowstring to be released. The rotational force from the hook resilient member 190 helps to move the hook 150 to away from the moon 170. FIG. 16 further illustrates the hook 150 further away from the moon 170 and free contact with the hook resilient member 190 as well as the moon 170.

Figure 18:
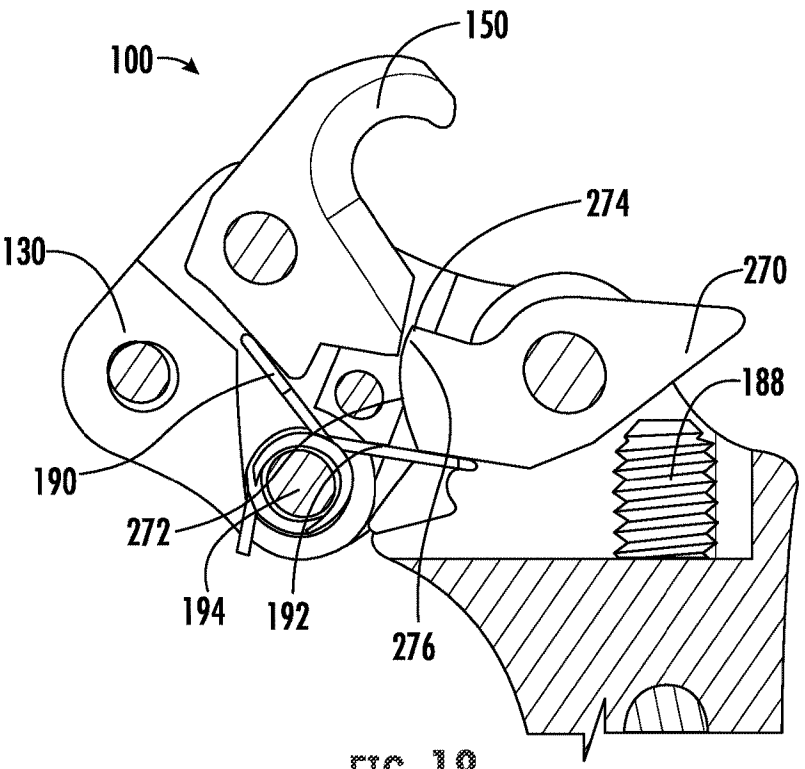
FIG. 18 depicts a partial front view of the exemplary archery release of FIG. 17 with a portion of the head removed according to aspects described herein.
Figure 17:
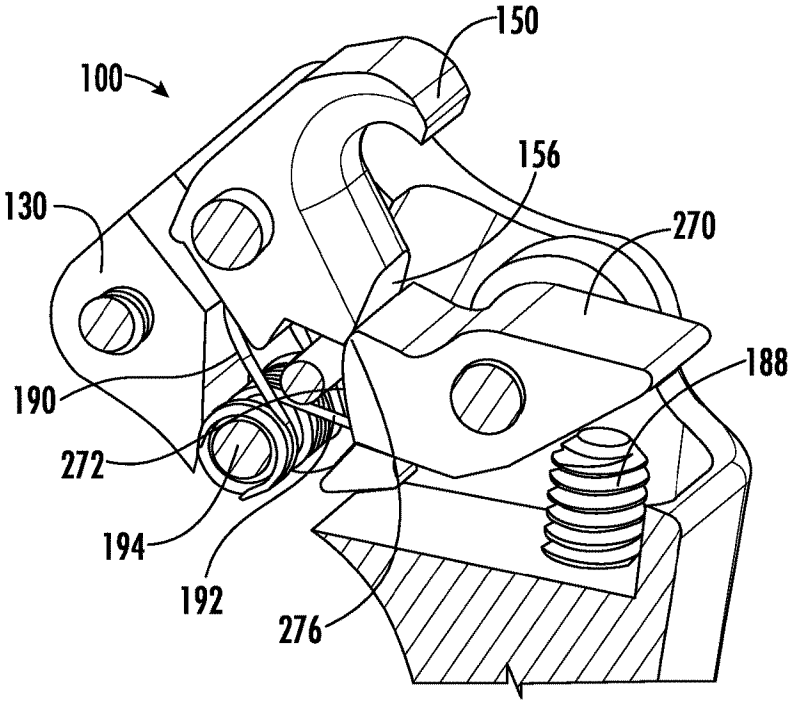
FIG. 17 depicts a partial perspective view of the archery release of FIG. 1 with an alternate moon and a portion of the head removed according to aspects described herein.

FIGS. 17 and 18 illustrate a portion of the exemplary release 100 that includes an alternate moon 270. The release 100 in FIGS. 17 and 18 operates in the same manner as the release 100 described above in FIGS. 1-16, but the alternate moon 270 has a pair of fixed upper surfaces with a step between them to create an audible sound to alert a user of the hook's movement from a holding position to an imminent position. The alternate moon 270 comprises a first curved upper surface 272, and a second curved upper surface 274 offset and forward from the first curved upper surface 272, such that there is a step 276 between the two surfaces. The first curved upper surface 272 and the second curved upper surface 274 may both have a generally curved convex shape. In some cases, the curved upper surfaces 272, 274 may have a similar curvature (i.e., within 5% of each other). As described above, the hook 150 may slide along the first curved upper surface 272 until dropping the step 276 and contacting the second curved upper surface 274 creating the audible sound when the hook has moved from a holding position to an imminent release position.

While the illustrated examples of FIGS. 1-18 show a hinge or back-tension style release, one skilled in the art would understand the hook resilient member assisted release may be used with an index finger activated release, a thumb activated release, or any other release aid that requires a trigger activation to release the bowstring with one or more fingers in addition to tension and time delayed activated releases.

FIGS. 19-22 illustrate an alternate body 310 for the archery release 100. The archery release 100 may operate in the same manner as the archery release 100 described above and shown in FIGS. 1-16 with the primary difference being that the body 310 may have an adjustable finger member 340. In FIGS. 19-22, the body 310 may include a base 312 with a plurality of finger engagement surfaces 314, 316, a thumb member 320, and a release extension 322 that extends outward from the base 312 from a fixed end 324 to a free end 326. Similar to the release 100 described above and shown in FIGS. 1-16, a head 130 may be pivotally connected to the release extension 322 with a hook 150 that is pivotally connected to the head 130, and a moon 170 that is pivotally connected to the release extension 322. In some examples, the fixed end 324 of the release extension 322 may be located the between the first finger engagement surface 314 and a second finger engagement surface 316. Each finger engagement surface 314, 316 may include a concave surface, while the release extension 322 may extend in a generally perpendicular direction to the base 312. The thumb member 320 may have a generally cylindrical shape and in some cases have a knurled or textured surface finish.

Figure 19:
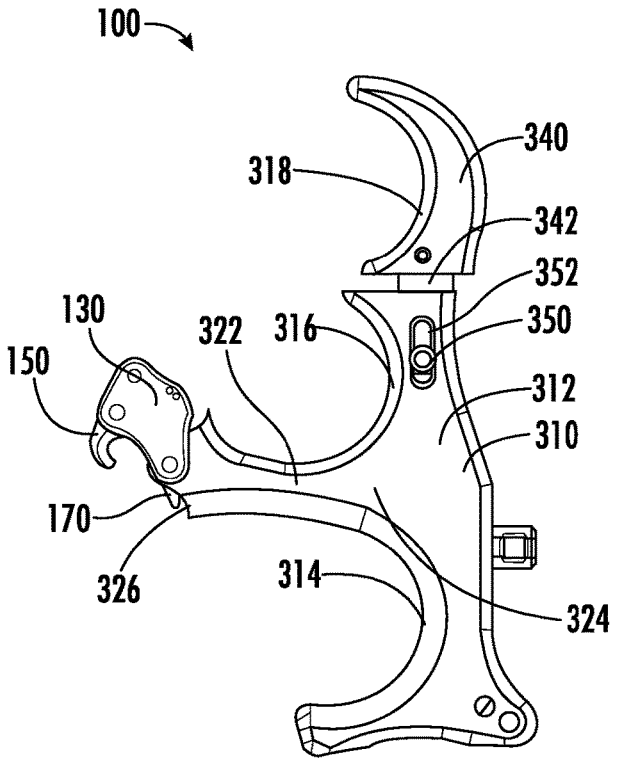
FIG. 19 depicts a rear view of the exemplary archery release with an alternate body according to aspects described herein.

The body 310 includes an adjustable finger member 340, which includes a finger engagement surface 318. The adjustable finger member 340 allows a user to keep their finger located at the center of the finger engagement surface 318 of the adjustable finger member 340. The adjustable finger member 340 includes a tab 342 that is received in an opening in the base 312 adjacent the end of the second finger engagement surface 316. The tab 342 is connected to a control member 350 that free to move within a slot 352 located on one side of the base 312. The slot 352 may have a linear shape. As the control member 350 moves within the slot 352, the adjustable finger member 340 moves in a corresponding manner as shown in FIG. 19. For example, the slot 352 may be arranged to in a top-to-bottom direction to allow the adjustable finger member 340 to be move in a top-to-bottom direction. The slot 352 may have a length within a range of 2 mm and 10 mm.

Figure 20:
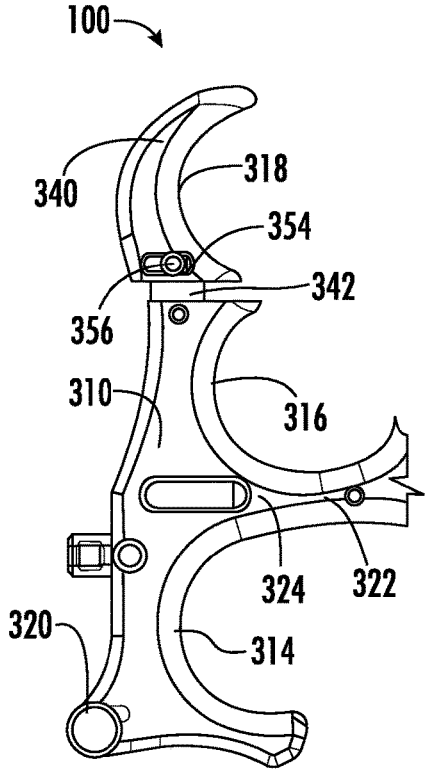
FIG. 20 depicts a partial front view of the exemplary archery release of FIG. 19 according to aspects described herein.
Figure 21:
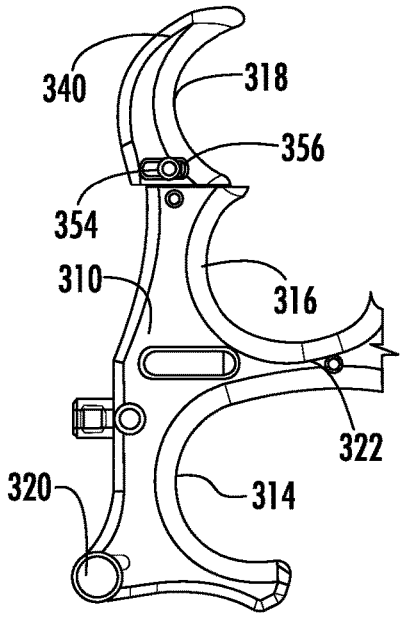
FIG. 21 depicts a partial front view of the exemplary archery release of FIG. 19 according to aspects described herein.
Figure 22:
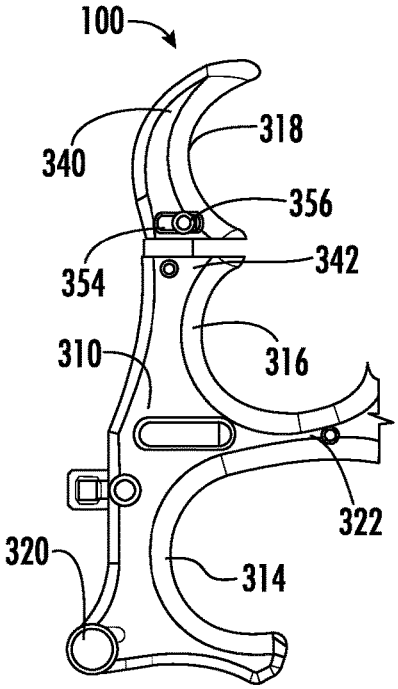
FIG. 22 depicts a partial front view of the exemplary archery release of FIG. 19 according to aspects described herein.

In addition, the adjustable finger member 340 may be able to move in a forward and rearward direction. The adjustable finger member 340 may include a slot 354 arranged in a forward and rearward direction (i.e., in a perpendicular direction to slot 352) as shown in FIG. 20. The slot 354 may in include a control member 356 that moves within the slot 354 and as the control member 356 moves within the slot 354, the adjustable finger member 340 moves in a forward or rearward direction. The slot 354 may have a length within a range of 1 mm and 8 mm. By having slots 352, 354 arranged in perpendicular directions, the adjustable finger member 340 can move in both a top-to-bottom direction and a forward-to-rearward direction. For example, FIGS. 19 and 20 illustrate the adjustable finger member 340 in a maximum outboard or extended position in a top direction. FIG. 21 illustrates the adjustable finger member 340 in a minimum outboard position while also being located in a maximum rearward position, while FIG. 22 illustrates the adjustable finger member 340 in a maximum outboard position and also in a maximum forward position. In some examples, the release 100 may include three fixed finger engagement surfaces, and the adjustable finger member 340 may include a fourth finger engagement surface.

The components, such as the body, the head, the hook, and the moon of the archery releases described herein may be primarily formed from metallic materials, such as aluminum, aluminum alloys, steel, steel alloys, titanium, and other metallic materials known to one skilled in the art. In some examples, the components may be manufactured using a non-metallic material such as a polymer-based material or carbon composite material.

The present disclosure is disclosed above and in the accompanying drawings with reference to a variety of examples. The purpose served by the disclosure, however, is to provide examples of the various features and concepts related to the disclosure, not to limit the scope of the disclosure. One skilled in the relevant art will recognize that numerous variations and modifications may be made to the examples described above without departing from the scope of the present disclosure.

What is claimed is:

1. An archery release comprising:

a body comprising:

a plurality of finger engagement surfaces, wherein each finger engagement surface includes a concave surface;

a moon pivotally connected to the body, wherein the moon comprises a curved upper surface;

a hook pivotally connected to the body, wherein the hook comprises a hook-shaped portion and a lower engaging surface;

a hook resilient member that applies a force to the hook; and wherein when the archery release is in a holding position, the lower engaging surface of the hook contacts the curved upper surface of the moon, and when the archery release is in a released position, the lower engaging surface of the hook is free of contact with the moon, wherein the force of the hook resilient member exerts a rotational force onto the hook to help rotate the hook and to move the hook away from the moon as the archery release moves from the holding position to the released position.

2. The archery release of claim 1, wherein the lower engaging surface of the hook is slidingly engaged with the curved upper surface of the moon when the archery release is in the holding position.

3. The archery release of claim 2, wherein the curved upper surface of the moon comprises a first curved upper surface and a second curved upper surface positioned below and adjacent to the first curved upper surface with a step between the first curved upper surface and the second curved upper surface.

4. The archery release of claim 3, wherein when the lower engaging surface of the hook moves from the first curved upper surface to the second curved upper surface, the archery release produces an audible sound to alert that the archery release is in an imminent release position.

5. The archery release of claim 3, wherein the first curved upper surface and the second curved upper surface both have a generally curved convex shape.

6. The archery release of claim 3, wherein the step is an adjustable step such that a distance between a leading edge of the first curved upper surface and a leading edge of the second curved upper surface is adjustable.

7. The archery release of claim 6, wherein the moon comprises an adjustable mechanical element on a first side of a moon pivot member and a step resilient member located on a second side of the moon pivot member opposite the first side such that the adjustable mechanical element is adjustable to modify the distance between the leading edge of the first curved upper surface and the leading edge of the second curved upper surface.

8. The archery release of claim 7, wherein the moon further comprises a magnetic element below the adjustable mechanical element that applies a magnetic force onto the adjustable mechanical element.

9. The archery release of claim 1, wherein the hook resilient member is a dual torsion spring that applies the force to a rear surface of the hook.

10. The archery release of claim 1, further comprising a head pivotally connected to the body; wherein the hook is pivotally connected to the head, and a moon resilient member that exerts a force on the moon; and wherein the hook resilient member and the moon resilient member are both arranged on a rod connected to the head.

11. The archery release of claim 1, further comprising: an adjustable finger member that is configured to move in top-to-bottom direction and in a forward-to-rearward direction.

12. The archery release of claim 1, wherein the body further includes a release extension that extends outward from between a first finger engagement surface and a second engagement surface of the plurality of finger engagement surfaces, wherein a lower surface of the moon is configured to contact a moon stop positioned on the release extension, and wherein a height of the moon stop is adjustable.

13. An archery release comprising:

a body comprising:

a plurality of finger engagement surfaces, wherein each finger engagement surface includes a concave surface;

a release extension that extends outward from between a first finger engagement surface and a second engagement surface of the plurality of finger engagement surfaces;

a head pivotally connected to the release extension, the head comprising a central opening;

a moon pivotally connected to the release extension, wherein the moon comprises a first curved upper surface, and a second curved upper surface, wherein the first curved upper surface is offset from and adjacent to the second curved upper surface;

a hook pivotally connected to the head and positioned within the central opening of the head, wherein the hook comprises a hook shaped portion, a rear surface, and a lower engaging surface;

a hook resilient member that applies a first force to the hook;

a moon resilient member that exerts a second force on the moon, and wherein the hook resilient member and the moon resilient member are both arranged on a rod connected to the head;

wherein when the archery release is in a holding position, the lower engaging surface of the hook contacts the first curved upper surface of the moon;

wherein when the archery release is in an imminent release position, the lower engaging surface of the hook contacts the second curved upper surface of the moon; and wherein when the archery release is in a released position, the lower engaging surface of the hook is free of contact with the moon, wherein the first force of the hook resilient member helps rotate the hook.

14. The archery release of claim 13, wherein the lower engaging surface of the hook moves from the first curved upper surface to the second curved upper surface, the archery release produces an audible sound to alert that the archery release is in the imminent release position.

15. The archery release of claim 13, wherein the lower engaging surface of the hook is slidingly engaged with the first curved upper surface of the moon when the archery release is in the holding position.

16. The archery release of claim 13, further comprising: an adjustable finger member that is configured to move in top-to-bottom direction and in a forward-to-rearward direction.

17. The archery release of claim 16, wherein the body includes a slot arranged on a side surface of the body, wherein movement of a control member in the slot moves the adjustable finger member relative to the body.

18. The archery release of claim 13, wherein the moon further comprises a third curved upper surface spaced from the first curved upper surface and adjacent to the second curved upper surface, such that when the archery release is in the holding position, the lower engaging surface of the hook contacts both the first curved upper surface and the third curved upper surface.

19. An archery release comprising:

a body comprising:

a plurality of finger engagement surfaces, wherein each finger engagement surface includes a concave surface;

a release extension that extends outward from between a first finger engagement surface and a second engagement surface of the plurality of finger engagement surfaces;

a head pivotally connected to the release extension, the head comprising a central opening;

a moon pivotally connected to the release extension, wherein the moon comprises a first curved upper surface, and a second curved upper surface, wherein a leading edge of the first curved upper surface is offset a distance from a leading edge of the second curved upper surface, wherein the moon comprises a mechanical element on a first side of a moon pivot member, such that adjustment of the mechanical element modifies the distance of the leading edge of the first curved upper surface to the leading edge of the second curved upper surface;

a hook pivotally connected to the head and positioned within the central opening of the head, wherein the hook comprises a hook shaped portion, a rear surface, and a lower engaging surface;

a hook resilient member that applies a force to the hook;

wherein when the archery release is in a holding position, the lower engaging surface of the hook contacts the first curved upper surface of the moon;

wherein when the archery release is in an imminent release position, the lower engaging surface of the hook contacts the second curved upper surface of the moon; and wherein when the archery release is in a released position, the lower engaging surface of the hook is free of contact with the moon, wherein the force of the hook resilient member helps to rotate the hook and to push the hook away from the moon.

20. The archery release of claim 19, wherein the hook resilient member is a dual torsion spring that applies the force to the rear surface of the hook.

* * * * *